US010485999B2

(12) United States Patent
Gray

(10) Patent No.: US 10,485,999 B2
(45) Date of Patent: Nov. 26, 2019

(54) PORTABLE PERSONAL EMERGENCY ESCAPE SYSTEM

(71) Applicant: ROBSON FORENSIC, INC., Lancaster, PA (US)

(72) Inventor: Edward A. Gray, Garnerville, NY (US)

(73) Assignee: Robson Forensic, Inc., Lancaster, PA (US)

( * ) Notice: Subject to any disclaimer, the term of this patent is extended or adjusted under 35 U.S.C. 154(b) by 0 days.

(21) Appl. No.: 15/405,948

(22) Filed: Jan. 13, 2017

(65) Prior Publication Data

US 2018/0200543 A1 Jul. 19, 2018

(51) Int. Cl.
*A62B 3/00* (2006.01)
*A62B 1/02* (2006.01)

(52) U.S. Cl.
CPC . *A62B 3/00* (2013.01); *A62B 1/02* (2013.01)

(58) Field of Classification Search
CPC ..... A62B 3/00; A62B 17/003; A62B 1/00; A62B 1/02; A62B 1/04; A62B 1/06
USPC ..... 248/542; 182/3–9; 5/81.1 R, 83.1; 294/140, 150, 164; 383/72, 74–76
See application file for complete search history.

(56) References Cited

U.S. PATENT DOCUMENTS 4,240,363 A * 12/1980 Troy ..... B65D 29/02 383/30
5,060,314 A * 10/1991 Lewis ..... A62B 17/003 2/2.5
5,970,517 A 10/1999 Jordan
6,398,410 B1 * 6/2002 Guerra ..... D06F 95/006 383/117
6,530,614 B1 * 3/2003 Wooten ..... A63B 29/02 294/215
8,261,877 B2 9/2012 Botti
8,556,313 B2 * 10/2013 Miller ..... A45F 3/04 294/82.1
9,072,920 B2 * 7/2015 Peters ..... A62B 1/02
9,168,400 B2 10/2015 Schubert et al.
9,901,756 B1 * 2/2018 Roberts ..... A62B 35/0037
2003/0115657 A1 * 6/2003 Kintzi ..... A41D 13/0512 2/69
2004/0055824 A1 * 3/2004 Karnes ..... A62B 1/10 182/234

(Continued)

FOREIGN PATENT DOCUMENTS

CN 201902146 U 7/2011
CN 202504516 U 10/2012
WO 2014083453 A1 6/2014

*Primary Examiner* — Christopher Garft
(74) *Attorney, Agent, or Firm* — Saxton & Stump LLC

(57) ABSTRACT

A portable personal emergency escape device, having a protective sack, a cable and a securing member. The protective sack is made of fire resistant or fire proof material and is sufficient in size to hold and enclose an individual therein. A first end of the cable is attached to the protective sack. The securing member is configured to be secured to an inside of a building structure and is attached to a second end of the cable. The cable has sufficient length to allow the protective sack to extend from the securing member to an outside of the building structure. The protective sack hangs below an opening in the building structure when deployed to provide the individual a temporary escape while awaiting rescue from the dangerous condition.

12 Claims, 3 Drawing Sheets

(56) References Cited

U.S. PATENT DOCUMENTS

| | | | | |
|---|---|---|---|---|
| 2005/0023081 | A1* | 2/2005 | Raby | A62B 1/02 182/7 |
| 2005/0223623 | A1* | 10/2005 | Hastings | A01K 97/02 43/44.99 |
| 2006/0055545 | A1 | 3/2006 | Graef et al. | |
| 2010/0011490 | A1* | 1/2010 | Stinson | A41D 13/0007 2/456 |
| 2010/0032236 | A1 | 2/2010 | Morris et al. | |
| 2011/0030119 | A1 | 2/2011 | Fee et al. | |
| 2011/0185655 | A1* | 8/2011 | Campbell | E04B 1/94 52/232 |
| 2011/0214939 | A1 | 9/2011 | Botti | |
| 2012/0067668 | A1 | 3/2012 | Rico | |
| 2015/0252619 | A1* | 9/2015 | Kramer | E06C 5/36 182/3 |
| 2016/0016017 | A1 | 1/2016 | Botti | |
| 2016/0023428 | A1* | 1/2016 | Adams | B32B 5/022 442/57 |
| 2016/0031164 | A1* | 2/2016 | Downs | B29C 70/542 428/12 |
| 2016/0261947 | A1* | 9/2016 | Ito | H04R 1/1033 |
| 2017/0017245 | A1* | 1/2017 | Jovanovic | G05D 16/10 |
| 2017/0119069 | A1* | 5/2017 | Alferez | A41D 19/0096 |
| 2017/0197392 | A1* | 7/2017 | Illeperuma | B32B 27/34 |
| 2017/0274231 | A1* | 9/2017 | Burkett | A62C 2/06 |

* cited by examiner

PORTABLE PERSONAL EMERGENCY ESCAPE SYSTEM

FIELD OF THE INVENTION

The present invention relates to a portable personal emergency escape system. In particular, the invention is directed to an emergency fire escape system which allows an individual to be suspended from the outside of buildings.

BACKGROUND OF THE INVENTION

There are a variety of fire escape devices for multi-level buildings and dwellings, and these range from complex elevators to folding ladders and simple harnesses for lowering people to the ground. Many of the latter devices utilize a harness attached to a rope that is wound about a pulley mechanism inside the dwelling. The rate of descent of the passenger may be controlled by hand out of a window or off a terrace.

Most of the devices described in the above patents are quite cumbersome and are installed at a single window or terrace for dedicated use. Such devices are not practical in an emergency situation where access to that particular door or window may be blocked. It is more desirable that a fire escape device be less cumbersome so that it is not considered an eyesore and portable for use at any window or other evacuation point.

Moreover, as these types of devices are used in lowering individuals to the ground, the existing prior art cannot be used in high-rise buildings, where the height of the individual above ground level is prohibitively high to allow for the individual to be lowered to the ground. Additionally this device can be used in low-rise buildings which are beyond range of fire ladder trucks Consequently, it is desirable to provide an improved portable personal emergency escape system and device that addresses the problems faced by the above prior art devices. The device should be portable so that it may be conveniently stored and usable at any of a variety of escape locations such as windows, terraces and building rooftops. The system and device should also be strong and stable enough to allow an individual to be suspended from the outside wall of building while awaiting rescue.

SUMMARY OF THE INVENTION

An object is to provide a portable personal emergency life safety device, designed to allow occupants of a high-rise or low-rise building who are exposed to a dangerous condition, such as, but not limited to, fire and/or smoke condition, a means of temporary escape, while awaiting rescue while the danger is actively present. The device allows for a final means of survival, if the high-rise building occupant cannot safely use a fire exit or other means of escape to flee the dangerous condition.

An object is to provide the user a final means of survival, if the high-rise or low-rise building occupant cannot safely use a Fire Exit or other means of escape to flee the fire and or smoke condition.

An object is to provide an emergency fire escape system which allows an individual to be suspended from the outside of building while awaiting rescue and/or while a fire/smoke condition is actively present.

An object is to provide a fire escape device that is portable and can be used at any of a variety of windows or other evacuation points.

An embodiment is directed to a portable personal emergency escape device, having a protective sack, a cable and a securing member. The protective sack is made of fire resistant or fire proof material and is sufficient in size to hold and enclose an individual therein. A first end of the cable is attached to the protective sack. The securing member is configured to be secured to an inside of a building structure and is attached to a second end of the cable. The cable has sufficient length to allow the protective sack to extend from the securing member to an outside of the building structure. The protective sack hangs below an opening in the building structure when deployed to provide the individual a temporary escape while awaiting rescue from the dangerous condition.

An embodiment is directed to a portable personal emergency escape device. The device includes a protective sack made of fire resistant or fire proof material which is sufficient in size to hold and enclose an individual therein. A top opening is provided in the protective sack and is dimensioned to allow the individual to enter the protective sack through the top opening. A cable receiving member is provided proximate the top opening. The positioning of the cable receiving member proximate the top opening causes the top opening to close when the protective sack is deployed with an individual inside. A retrieval member is positioned on an outside of the protective sack. An access opening is provided proximate the retrieval member and extends through a wall of the protective sack. A first end of the cable is attached to the cable receiving member of the protective sack. A securing member is attached to a second end of the cable. The securing member is configured to be secured to an inside of a building structure. A projection extends from the securing member and is configured to facilitate the breakage of a window. The cable has sufficient length to allow the protective sack to extend from the securing member to an outside of the building structure. The protective sack hangs below an opening in the building structure when deployed to provide the individual a temporary escape while awaiting rescue from the dangerous condition.

An embodiment is directed to a portable personal emergency escape device, having a protective sack, a cable and a securing member. The protective sack is made of fire resistant or fire proof material and is sufficient in size to hold and enclose an individual therein. The protective sack has a dead weight capacity of at least 300 pounds and a shock load capacity of at least 500 pounds. A first end of the cable is attached to the protective sack. The securing member is configured to be secured to an inside of a building structure and is attached to a second end of the cable. The securing member has a weight capacity of at least 300 pounds and can withstand temperatures of at least 1000 degrees Fahrenheit. The cable has sufficient length to allow the protective sack to extend from the securing member to an outside of the building structure. The cable has a weight capacity of at least 300 pounds and can withstand temperatures of at least 1000 degrees Fahrenheit. The protective sack hangs below an opening in the building structure when deployed to provide the individual a temporary escape while awaiting rescue from the dangerous condition.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
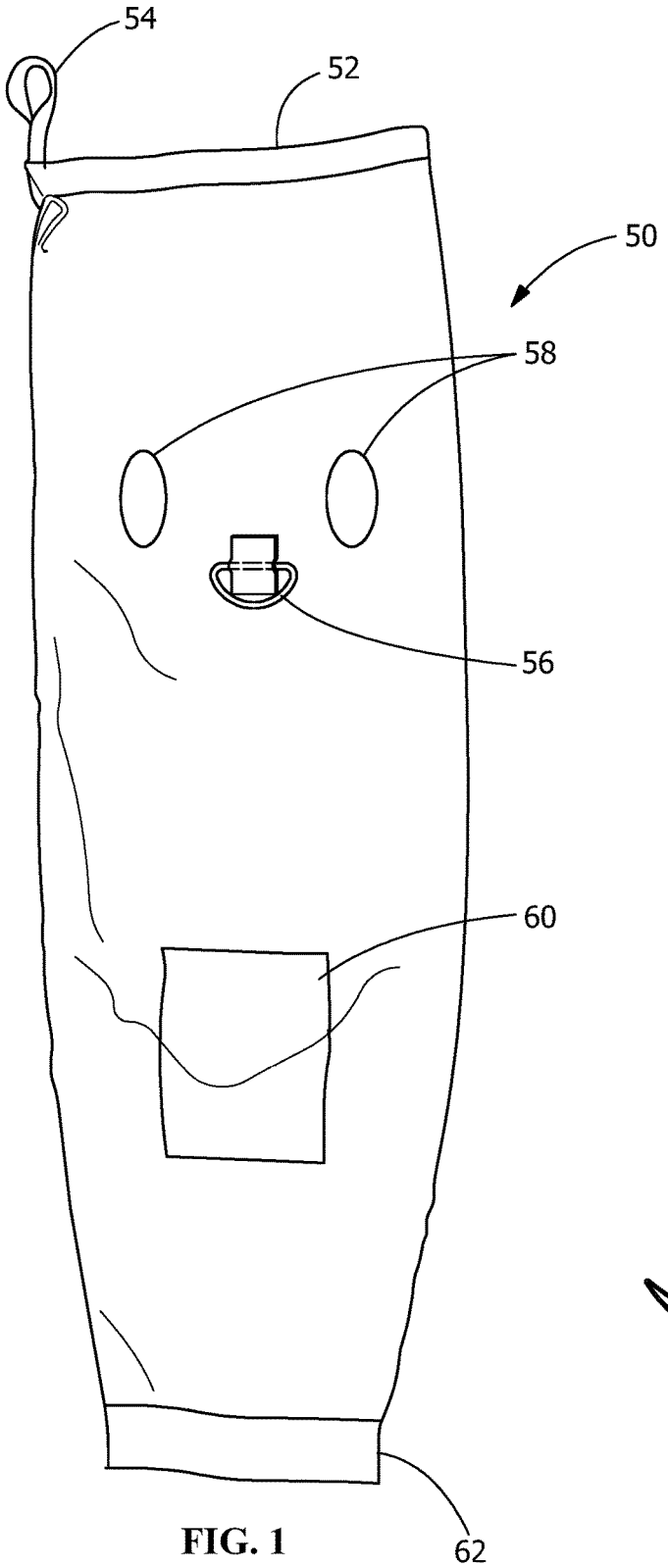
FIG. 1 is a side elevational view of an illustrative embodiment of a portable personal emergency escape device according to the present invention.
Figure 2:
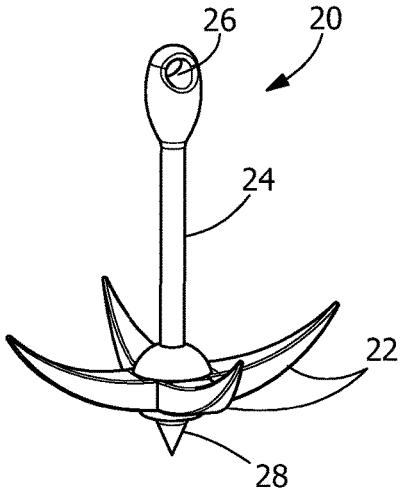
FIG. 2 is a perspective view of an illustrative securing member which is used to secure the portable personal emergency escape device of FIG. 1 to a building or structure.
Figure 3:
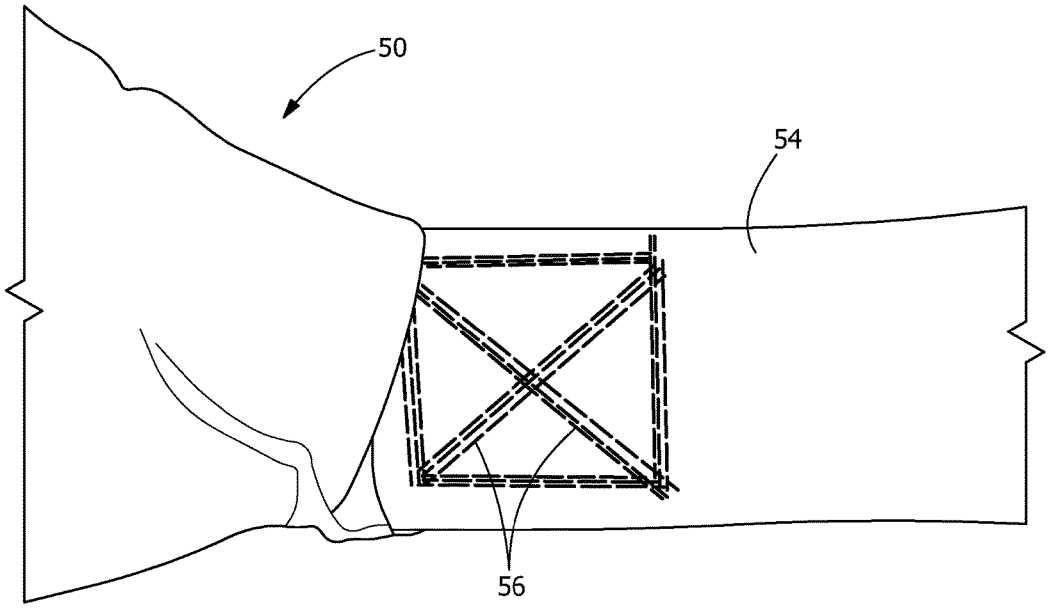
FIG. 3 is an enlarged side view of a portion of a cable receiving member of the portable personal emergency escape device.
Figure 5:
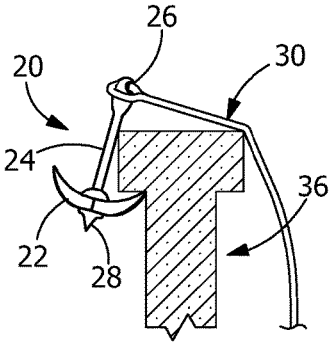
FIG. 5 is a cross-sectional view of the building with the securing member of FIG. 2 secured to a window frame of the building.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 4:
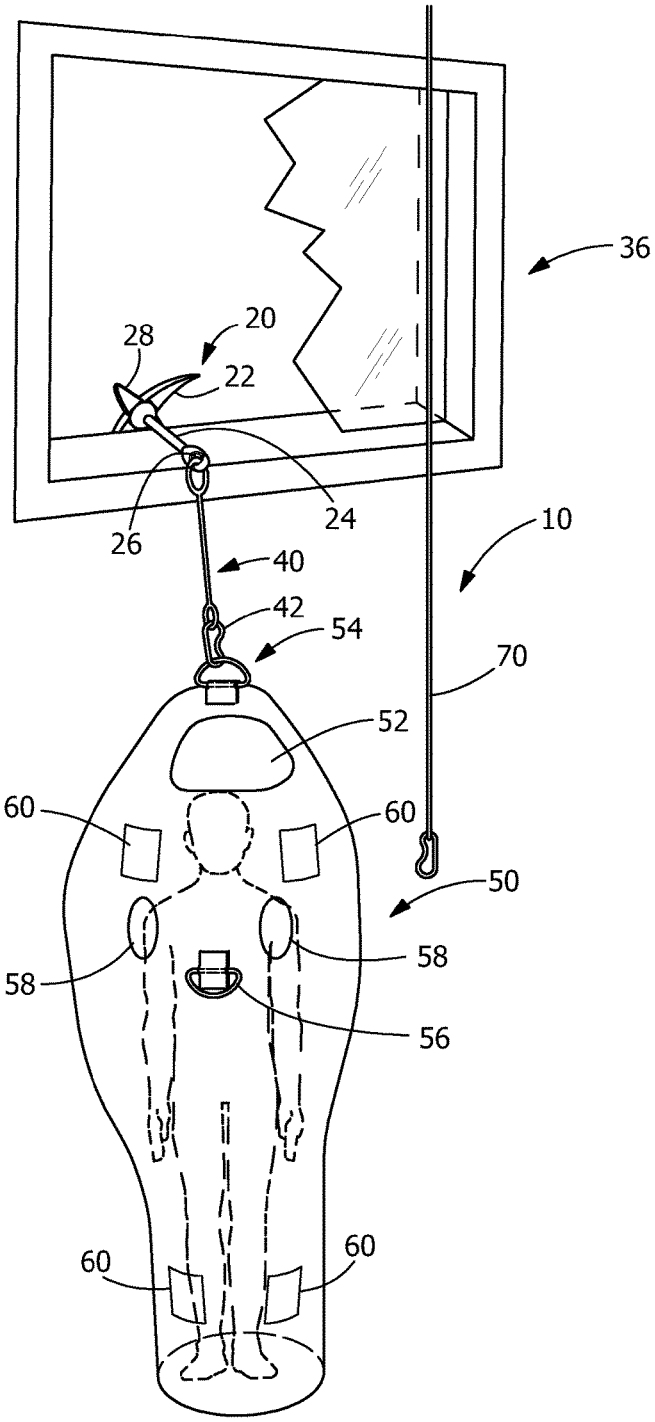
FIG. 4 is a diagrammatic perspective view of the portable personal emergency escape system with the portable personal emergency escape device of FIG. 1 positioned outside of the building with an individual positioned therein.

Referring to the FIG. 4, an illustrative embodiment of a personal emergency escape system and device 10 is shown. The device 10 includes a securing member 20, a cable 40 and a holding and protective sack 50.

In the embodiment shown, the securing member 20 is a folding grappling hook with multiple claws or hooks 22 which extend from a center shaft 24. The center shaft 24 has an opening 26 to allow for proper attachment to the cable 40. In the embodiment shown, the hooks 22 fold inward to accommodate storage. The end of the center shaft 24 opposite the opening 26 has a projection 28 which extends beyond the hooks 22. The projection 28 is configured to facilitate the breakage of window glass, if the window does not open to the outside of the building.

Figure 6:
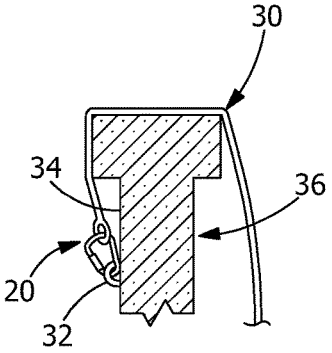
FIG. 6 is a cross-sectional view of the building with an alternate securing member secured to the building.

Alternate securing members 20 may be used without departing from the scope of the invention. For example, as shown in FIG. 6, the securing member 20 may be a carabiner attached to the end of the cable 30. The carabiner may be attached to a mounting ring 32 which is mounted to the wall 36 or other structure of the building 34.

The securing member 20 must be made of material which has at least sufficient strength to support an individual who is suspended outside of the building for a sufficient amount of time to allow for the rescue of the individual, as will be more fully described. In the embodiment shown, the securing member 20 has a capacity of at least 300 pounds, but other securing members 20 with differing weight capacities can be used to support appropriate weights. The securing member 20 must also be made of material which can withstand typical high-rise or low-rise building fire temperatures of at least 1000 degrees Fahrenheit.

The cable 40 has first end that attaches to the securing member 20 and a second end that attaches to the protective sack 50. In order to facilitate the attachment of the cable 40 to the securing member 20 and the protective sack 50, a carabiner, hook, snap hook or other similar device 42 may be integrally attached to the cable 40 at either end thereof. Alternate known methods of securing the cable to the securing member 20 and the protective sack 50 may be used.

The cable 40 must have a length sufficient to allow the cable 40 to extend from the securing member 20, which is positioned inside of the building or structure, to the protective sack 50 which is positioned outside of the building or structure when deployed. The cable 40 is made of material which has at least sufficient strength to support an individual who is suspended outside of the building for a sufficient amount of time to allow for the rescue of the individual, as will be more fully described. In the embodiment shown, the cable 40 has a capacity of at least 300 pounds, but other cable 40 with differing weight capacities can be used to support appropriate weights. The cable 40 must also be made of material which can withstand typical high-rise building fire temperatures of at least 1000 degrees Fahrenheit. In the embodiment shown, the cable 40 is made from a high tensile alloy steel, such as stainless steel, but other materials may be used.

Referring to FIG. 1, the protective sack 50 has a generally cylindrical configuration dimensioned to allow an individual to be positioned in and completely enclosed by the protective sack 50. The protective sack 50 is made from material which has at least sufficient strength to support an individual who is suspended outside of the building for a sufficient amount of time to allow for the rescue of the individual, as will be more fully described. In the embodiment shown, the protective sack 50 has a dead weight capacity of at least 300 pounds and a shock load of capacity of at least 500 pounds, but other protective sacks 50 with differing weight capacities can be used to support appropriate weights. The protective sack 50 must also be made of material which is fire proof, fire retardant or fire resistant, such as, but not limited to, DuPont Fire Resistant Nomex.

A top opening 52 is provided at the top end of the protective sack 50. The opening 52 is dimensioned to allow an individual to enter the protective sack 50 through the opening 52. A cable receiving member 54 is provided proximate the opening 52. In the illustrative embodiment shown, the cable receiving member 54 is a load bearing strap or loop made from materials having the strength, abrasion resistance and heat resistance characteristics required. The cable receiving member 54 is configured to absorb some of the shock load as the protective sack 50 is deployed. Lock stitching 56 is used at the sewn strap joints to prevent failure of the cable receiving member 54 and stitching 56 when the protective sack 50 is deployed.

In the illustrative embodiment shown, as shown in FIG. 4, the positioning of the cable receiving member 54 proximate the opening 52 causes the opening 52 to pull together, cinch or close when the protective sack 50 is deployed with an individual inside.

In alternative embodiments, the cable receiving member 54 may be a D-ring, O-ring, carabiner or other type of connector. In such embodiments, a strap may be provided between the cable receiving member 54 and the protective sack 50 to provide for energy absorption. Alternatively, the protective sack 50 may be provided with energy absorption characteristics. In other alternative embodiments, a draw cord may be provided about the opening 52 to allow the individual to close the opening 52 when the individual is positioned in the protective sack 50.

As best shown in FIG. 4, the protective sack 50 includes a retrieval member 56 on the outside of the protective sack 50. The retrieval member 56 may be a D-ring, O-ring, carabiner or other type of connector. The retrieval member 56 is positioned on the side of the protective sack 50. Additional retrieval members 56 may be positioned in other areas of the protective sack 50.

One or more access openings 58 are provided proximate retrieval member 56. The openings 58 extend through the wall of the protective sack 50 to allow the individual inside the protective sack 50 to extend his hands and/or arms through the openings 58, as will be more fully described.

The cable 40 and/or the protective sack 50 may include reflective panels, painted areas or fibers 60 which are visible at night or in less than ideal conditions.

Prior to use, the securing member 20, cable 40 and protective sack 50 may be stored in a folded configuration inside the small storage bag 62 (FIG. 1). In the embodiment shown, the storage bag 62 is an integral part of or integrally attached to the protective sack 50 with a panel of the storage bag 62 integrally formed with a wall of the protective sack 50 to form a single unit structure. Alternatively, the protective sack 50 and the storage bag 62 are separate items.

When the system 10 is needed, the protective sack 50 is pulled from the storage bag 62 and unfolded into an extended, bag configuration designed to hold the individual. The securing member 20 and cable 40, also stored in the storage bag 62, are also removed from the storage bag 62. In order to allow for rapid deployment, the securing member 20 is attached and stored to the cable 40 in the storage bag 62. The cable 40 is also attached and stored to the protective sack 50 in the storage bag 62. However, other methods of storage may be used without departing from the invention.

If the windows in the building do not open, the individual must break the glass in order to deploy the protective sack 50. Once removed from the storage bag 62, the securing member 20 may be used to break the glass. In the embodiment shown, the projection 28 of the center shaft 24 of the securing member 20 is configured into a point to provide additional leverage to facilitate the breakage of the window.

With the window open, the securing member 20 is secured to an anchor point proximate to a window ledge/frame of the high-rise building. If no window ledge anchor point is present, the cable 40 may be attached to another safe point within the building by looping the cable 40 around on itself and using the securing member 20 to maintain the cable 40 in position.

With the securing member 20 and cable 40 secure, the individual steps into the protective sack 50, such that the individual is completely enclosed by the protective sack 50. In the extreme event that the individual cannot survive any other way, the individual exits the window causing the protective sack 50, with the individual housed therein, to be lowered outside the building below the window. The protective sack 50 and enclosed individual hang in this position to await rescue services from emergency personnel or the like.

When the event which caused the individual to exit the building in the protective sack is controlled, rescue services may pull the protective sack and the individual back through the window to safety. Alternatively, if the event is not controlled in a timely and safe manner, rescue services may lower a cable 70 from an upper floor or helicopter to the individual. In such case, the individual would extend their arms through openings 58 to retrieve the cable and attach the cable to the retrieval member 56. This will allow rescue services to raise or lower the protective sack 50 and individual to safety.

The device 10 may be provided in buildings for building occupants similar to other building fire code-required enhancements, i.e. fire hoses on each floor, et. al. Alternatively, the device 10 may be purchased by individuals who may use them for their own self-protection investment, for multi-floor residential dwellings and other applications such as while traveling, etc.

Although the illustrative device 10 is shown for use with one individual, the device may be enlarged to accommodate more than one individual. In embodiments in which more than one individual is to be enclosed, the weight capacity of the individual components of the system must be increased to accommodate the additional weight of individuals.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components (for example, the protective sack may be replaced with a harness) without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A portable personal emergency escape device, comprising:

a protective sack sufficient in size to hold and completely enclose an individual therein, the protective sack made of fire proof material to allow the individual to be suspended from an outside of a high-rise building structure while a dangerous condition is active in the high-rise building structure, a top opening is provided in the protective sack, the opening is configured to allow the individual to enter the protective sack through the top opening;

a cable, a first end of the cable attached to the protective sack, the cable made of material which can withstand temperatures of 1000 degrees Fahrenheit to allow the individual to be suspended from the outside of the high-rise building structure while the dangerous condition is active in the high-rise building structure;

a securing member attached to a second end of the cable, the securing member configured to be secured to an inside of the high-rise building structure;

the cable is configured to allow the protective sack to be suspended outside of the high-rise building structure below an opening in the high-rise building structure until rescue services arrive;

the protective sack having a cable receiving member provided proximate the top opening, the cable receiving member is a load bearing strap, the cable receiving member closes the top opening when the protective sack is suspended with the individual enclosed therein;

a retrieval member provided on an outside surface of the protective sack, the retrieval member configured to accept a retrieval cable, access openings positioned proximate the retrieval member and extending through a wall of the protective sack, the access openings configured to allow the individual enclosed in the protective sack to extend hands or arms through the access openings to physically engage the retrieval member and the retrieval cable without exiting the protective sack.

2. The portable personal emergency escape device as recited in claim 1, wherein the securing member is a grappling hook with multiple hooks which extend from a center shaft.

3. The portable personal emergency escape device as recited in claim 2, wherein the grappling hook is a folding grappling hook.

4. The portable personal emergency escape device as recited in claim 2, wherein an end of the center shaft has a pointed projection configured to facilitate the breakage of a window or the like.

5. The portable personal emergency escape device as recited in claim 1, wherein the securing member is a carabiner or snap hook which cooperates with a mounting ring mounted to a wall of the high-rise building structure.

6. The portable personal emergency escape device as recited in claim 1, wherein the retrieval member is a D-ring.

7. The portable personal emergency escape device as recited in claim 1, wherein the cable and/or the protective sack includes reflective panels, painted areas or fibers that are visible at night.

8. The portable personal emergency escape device as recited in claim 1, wherein the securing member, the cable and the protective sack are stored in a storage bag which is integrally attached to the protective sack.

9. A portable personal emergency escape device, comprising:

a protective sack sufficient in size to hold and completely enclose an individual therein, the protective sack made of fire proof material to allow the individual to be suspended from an outside of a high-rise building structure while a dangerous condition is active in the high-rise building structure, a top opening provided in the protective sack, the top opening dimensioned to allow the individual to enter the protective sack through the top opening, a support cable receiving member provided proximate the top opening, the positioning of the support cable receiving member proximate the top opening is configured to cause the top opening to close when the protective sack is deployed with an individual inside, a retrieval member positioned on an outside surface of the protective sack, the retrieval member configured to accept a retrieval cable, access openings positioned proximate the retrieval member and extending through a wall of the protective sack, the access openings configured to allow the individual enclosed in the protective sack to extend hands or arms through the access openings to physically engage the retrieval member and the retrieval cable without exiting the protective sack;

a support cable, a first end of the support cable attached to the support cable receiving member of the protective sack, the support cable made of material which can withstand temperatures of 1000 degrees Fahrenheit;

a securing member attached to a second end of the support cable, the securing member configured to be secured to an inside of the high-rise building structure, a pointed projection extending from the securing member, the pointed projection configured to facilitate the breakage of a window;

the support cable configured to allow the protective sack to be suspended outside of the high-rise building structure below an opening in the high-rise building structure until rescue services arrive.

10. The portable personal emergency escape device as recited in claim 9, wherein the securing member is a folding grappling hook with multiple hooks which extend from a center shaft.

11. The portable personal emergency escape device as recited in claim 9, wherein the support cable receiving member is a load bearing strap or loop, the support cable receiving member is configured to absorb some of the shock load as the protective sack is deployed.

12. The portable personal emergency escape device as recited in claim 9, wherein the support cable and/or the protective sack includes reflective panels, painted areas or fibers that are visible at night.

* * * * *